US009436135B2

(12) United States Patent
Sone et al.

(10) Patent No.: US 9,436,135 B2
(45) Date of Patent: Sep. 6, 2016

(54) TONER PATTERN DENSITY CORRECTION IN AN IMAGE FORMING APPARATUS

(71) Applicants: Keita Sone, Tokyo (JP); Nobutaka Takeuchi, Kanagawa (JP); Shinichi Akatsu, Kanagawa (JP); Tomohide Takenaka, Kanagawa (JP); Kohta Fujimori, Kanagawa (JP); Tetsuya Muto, Tokyo (JP); Akira Yoshida, Tokyo (JP); Keita Gotoh, Kanagawa (JP); Yuuichiroh Uematsu, Kanagawa (JP); Kazufumi Kimura, Kanagawa (JP)

(72) Inventors: Keita Sone, Tokyo (JP); Nobutaka Takeuchi, Kanagawa (JP); Shinichi Akatsu, Kanagawa (JP); Tomohide Takenaka, Kanagawa (JP); Kohta Fujimori, Kanagawa (JP); Tetsuya Muto, Tokyo (JP); Akira Yoshida, Tokyo (JP); Keita Gotoh, Kanagawa (JP); Yuuichiroh Uematsu, Kanagawa (JP); Kazufumi Kimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/740,175

(22) Filed: Jun. 15, 2015

(65) Prior Publication Data

US 2015/0362868 A1 Dec. 17, 2015

(30) Foreign Application Priority Data

Jun. 16, 2014 (JP) ..... 2014-122954

(51) Int. Cl.
*G03G 15/16* (2006.01)

(52) U.S. Cl.
CPC ..... *G03G 15/1615* (2013.01)

(58) Field of Classification Search
CPC ..... G03G 15/1516
USPC ..... 399/49
See application file for complete search history.

(56) References Cited

U.S. PATENT DOCUMENTS

| | | | | |
|---|---|---|---|---|
| 2009/0202263 | A1 | 8/2009 | Yoshida et al. | |
| 2009/0324267 | A1 | 12/2009 | Yoshida et al. | |
| 2010/0226664 | A1 | 9/2010 | Yoshida et al. | |
| 2010/0226677 | A1* | 9/2010 | Matsuo | G03G 15/0131 399/66 |
| 2011/0228355 | A1 | 9/2011 | Morita et al. | |
| 2014/0169814 | A1 | 6/2014 | Uematsu et al. | |
| 2014/0268242 | A1 | 9/2014 | Kaneko et al. | |
| 2014/0270827 | A1 | 9/2014 | Muto et al. | |
| 2014/0294412 | A1 | 10/2014 | Tanaka et al. | |

FOREIGN PATENT DOCUMENTS

| | | | |
|---|---|---|---|
| JP | 5-188783 | | 7/1993 |
| JP | 2006071954 | A * | 3/2006 |
| JP | 2006-139180 | | 6/2006 |
| JP | 2006-293240 | | 10/2006 |
| JP | 2007047585 | A * | 2/2007 |
| JP | 2012042740 | A * | 3/2012 |
| JP | 2013-182153 | | 9/2013 |

* cited by examiner

*Primary Examiner* — Quana M Grainger
(74) *Attorney, Agent, or Firm* — Duft Bornsen & Fettig LLP

(57) ABSTRACT

An image forming apparatus includes an endless belt-shaped image bearer that is rotatably supported and entrained around rollers; a transfer member positioned to contact an outer surface of the image bearer; a transfer device to transfer a toner image conveyed while being carried on the outer surface of the image bearer onto a transfer medium conveyed between the image bearer and the transfer member; a toner image sensor to detect the toner image transferred onto the transfer medium; and a conveyance speed controller to fine-tune a conveyance speed of the transfer medium. Based on fine-tuning data of the conveyance speed controller, a detection result of the toner image sensor is corrected and image forming conditions are corrected based on the corrected detection result.

11 Claims, 3 Drawing Sheets

TONER PATTERN DENSITY CORRECTION IN AN IMAGE FORMING APPARATUS

CROSS-REFERENCE TO RELATED APPLICATION

The present application claims priority pursuant to 35 U.S.C. §119(a) from Japanese patent application number 2014-122954, file on Jun. 16, 2014, the entire disclosure of which is incorporated by reference herein.

BACKGROUND

1. Technical Field

The present invention relates to an image forming apparatus, and in particular relates to toner pattern density correction of a toner pattern formed on a secondary transfer belt in the image forming apparatus.

2. Background Art

In an image forming apparatus employing electrophotography, to maintain optimum image density of the printed image it is necessary to execute an image density control operation periodically.

The image density control operation includes a first density control and a second density control. The first density control is performed out of synchrony with a printing operation. The second density control is performed in synchrony with the printing operation during printing using a blank area between transfer sheets or at an end of the sheet. Herein, the term "image forming apparatus" means and includes a copier, a printer, a facsimile machine, or a multifunction apparatus combining the capabilities of these apparatuses, and can also include any device that forms an image.

In the first density control, a plurality of monochrome toner patterns is formed on an intermediate transfer belt, and density of each toner pattern is detected by a reflection-type optical sensor. Based on a relation between the detected amount of adhered toner and image forming conditions such as charging bias, development bias, and exposure, the image forming condition in printing is determined.

To perform the first density control, however, the printing operation needs to be suspended. As a result, productivity in continuous printing will be reduced. Therefore, the first density control is performed only when the image fluctuation is high, thereby preventing the productivity from decreasing. For example, the first density control is performed when the power is on, before the start of printing, after a predetermined number of prints are generated, or when image forming operation is terminated.

In the second density control, a plurality of toner patterns for adjusting image density of each color is formed outside the image area during continuous printing, and density of each toner pattern is detected by a reflection-type optical sensor. A target adhesion amount stored in a memory and the detected amount of adhered toner are compared and, based on the detection result, toner density of the developer in the developing device is adjusted. With this, the image density between the two density controlling operations is maintained.

SUMMARY

In one embodiment of the disclosure, there is provided an image forming apparatus including an endless belt-shaped image bearer that is rotatably supported and entrained around rollers; a transfer member positioned to contact an outer surface of the image bearer; a transfer device to transfer a toner image conveyed while being carried on the outer surface of the image bearer onto a transfer medium conveyed between the image bearer and the transfer member; a toner image sensor to detect the toner image transferred onto the transfer medium; and a conveyance speed controller to fine-tune a conveyance speed of the transfer medium. Based on fine-tuning data of the conveyance speed controller, a detection result of the toner image sensor is corrected and image forming conditions are corrected based on the corrected detection result.

In another embodiment of the disclosure, there is provided a method of controlling image density of an image formed by an image forming apparatus as described above, including a first image density control process in which the density control is performed regularly, when the image forming apparatus is not forming an image; and a second image density control process in which the density control is performed regularly in synchrony with image formation but between successive sheets.

These and other objects, features, and advantages of the present invention will become apparent upon consideration of the following description of the preferred embodiments of the present invention when taken in conjunction with the accompanying drawings.

DETAILED DESCRIPTION

Figure 1:
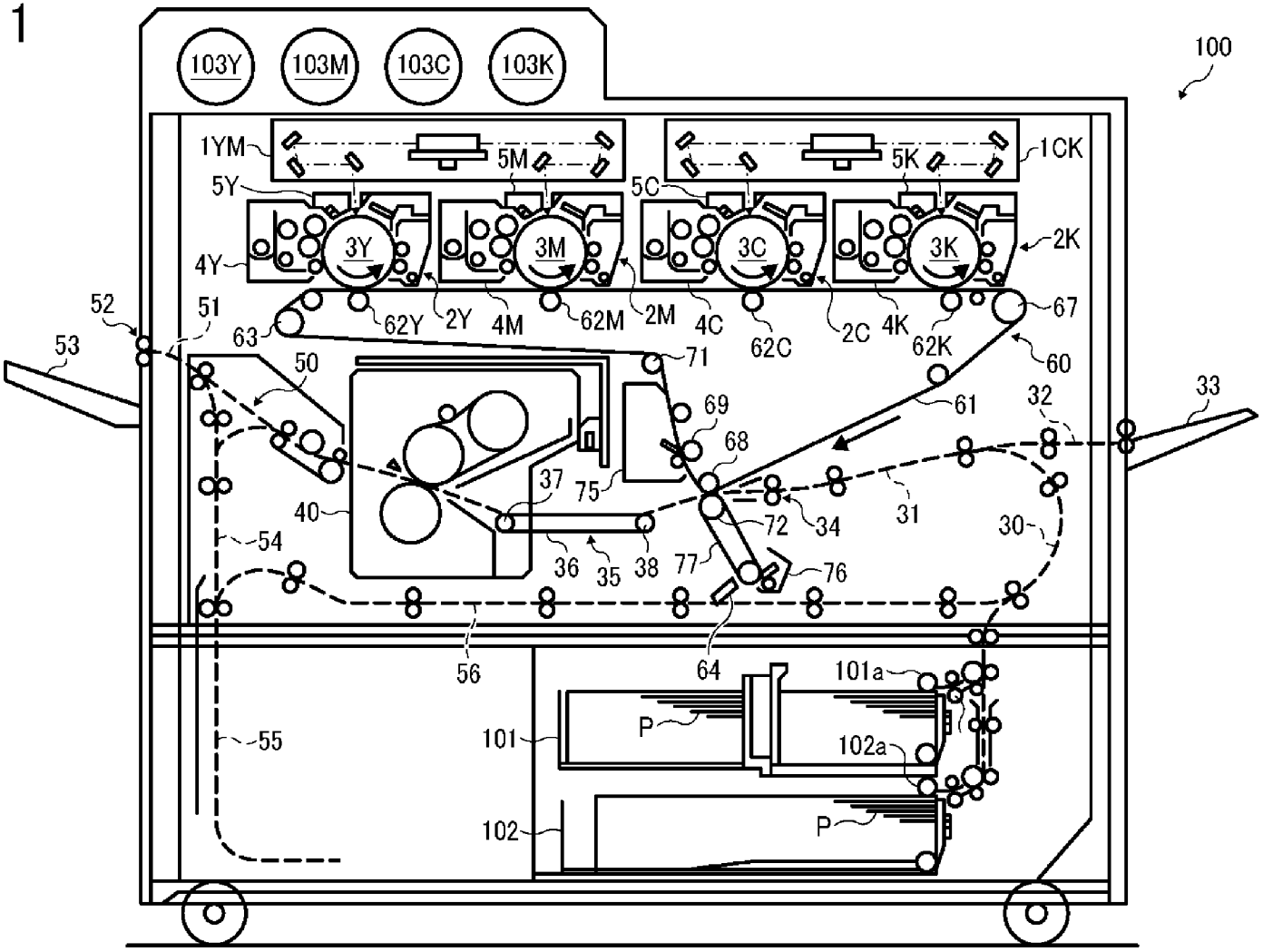
FIG. 1 is a schematic view of the basic structure of a printer as an image forming apparatus according to an embodiment of the present invention.

The present invention relates to an image forming apparatus or a printer that includes performing a second density control on a secondary transfer belt in synchrony with printing; and fine-tuning a speed of the secondary transfer belt to thus obtain an optimal image. In short, based on the linear speed information to be fine-tuned depending on the thickness of the sheet, the detection value of the pattern for the second density control detected in synchrony with the printing can be corrected. For example, the linear speed of the secondary transfer belt is changed in accordance with the thickness of the sheet. In contrast, the toner pattern is transferred to an area without a sheet for the density control, and the density of the toner pattern may change in accordance with the linear speed of the secondary transfer belt, so that the correction of the toner pattern density is performed. Thus, the present invention aims to finely detect a pattern for image density adjustment on the secondary transfer belt even when the linear speed of the secondary transfer belt is fine-tuned during printing.

Contemporary image forming apparatuses employing an intermediate transfer method include a transfer device such as an intermediate transfer belt with an elastic surface layer, so that a conveyed sheet can be handled suitably. Use of the intermediate transfer belt having an elastic layer improves adhesion of the sheet in transferring the toner image thereon even with the convexity and concavity of the surface of the recording media, and the toner image is optimally transferred to various types of recording media. However, an intermediate transfer belt with an elastic surface layer is generally less glossy, which adversely affects accurate detection of the toner image density when the density of the toner pattern formed on the above-described intermediate transfer belt is detected with an optical sensor to control density of the toner image.

As a result, in a structure having an elastic surface on the intermediate transfer belt, the toner pattern for the image density control is transferred from the intermediate transfer belt to the secondary transfer belt, so that the density of the toner pattern on the secondary transfer belt can be detected by the optical sensor disposed on the secondary transfer belt.

In addition, to obtain a quality image when transferring the image on the intermediate transfer belt onto the sheet, both the intermediate transfer belt and the sheet must move at the same speed. However, the sheet is conveyed in accordance with a rotational speed of the secondary transfer belt. As a result, the surface speed of the sheet changes due to variations in a circumferential length of the belt and a diameter of the rollers around which the belt is wound due to a sheet thickness and the environmental change, so that the formed image is disturbed.

There is a method for obtaining a quality image by fine-tuning a linear speed of the secondary transfer belt according to a use status such as sheet thickness or environment. The method includes detecting the pattern for adjusting the image density on the secondary transfer belt, and fine-tuning the speed of the secondary transfer according to the thickness of the conveyed sheet. The thus-configured image forming apparatus can provide a quality image by fine-tuning the secondary transfer speed. However, the detection value of the pattern for the second density control performed in synchrony with printing changes, thereby causing the image density to vary.

Alternatively, a pattern for adjusting the image density may be transferred to the secondary transfer belt, and the density of the pattern on the secondary transfer belt is detected by the optical sensor disposed on the secondary transfer belt to improve control a surface speed of the sheet and to apply an elastic surface layer on the intermediate transfer belt. However, such a configuration still does not solve the problem that the detection value of the pattern for the second density control performed in synchrony with printing changes to detect the pattern for adjusting the image density on the secondary transfer belt, and fine-tuning the speed of the secondary transfer according to the thickness of the conveyed sheet.

According to at least one embodiment of the present invention, the detection value of the pattern for the second density control detected in synchrony with the printing is corrected based on the linear speed fine-tuned according to the thickness of the sheet. Accordingly, even though fine-tuning of the linear speed of the secondary transfer belt is performed in accordance with the thickness of the sheet being conveyed during printing, the pattern for the image density adjustment can be detected with high precision on the secondary transfer belt.

FIG. 1 is a schematic view of the basic structure of a printer as an image forming apparatus according to an embodiment of the present invention.

As illustrated in FIG. 1, the present printer 100 includes four process units 2Y, 2M, 2C, and 2K to form a toner image of respective colors of yellow (Y), magenta (M), cyan (C), and black (K). In addition, the present printer 100 includes a sheet feed path 30, a conveyance path 31 before transferring, a manual sheet feed path 32, a manual tray 33, a registration roller pair 34, a conveyance belt unit 35, a fixing device 40, a conveyance switchover device 50, a sheet ejection path 51, a sheet ejection roller pair 52, a sheet ejection tray 53, a first sheet cassette 101, a second sheet cassette 102, and a resending device. In addition, two optical writing units 1YM and 1CK are disposed. Each of the process units 2Y to 2K includes drum-shaped photoconductors 3Y, 3M, 3C, and 3K, each serving as a latent image bearer.

The first sheet cassette 101 and the second sheet cassette 102 each contain a stack of recording sheets P inside thereof. When the sheet feed roller 101a or 102a rotates, a topmost recording sheet P is fed out toward the sheet feed path 30. The sheet feed path 30 is followed by the conveyance path 31 before transferring, to convey the recording sheet immediately before the secondary transfer nip, which will later be described. The recording sheet P fed out from the sheet cassettes 101, 102 serving as a recording member passes through the sheet feed path 30 and enters into the conveyance path 31 before transferring.

The manual tray 33 is openably disposed on a side of the printer housing and receives a sheet stack manually placed thereon when the manual tray 33 is opened. A topmost recording sheet P in the manually placed sheet stack is fed out by a feed-out roller of the manual tray 33 toward the sheet feed path 31 before transferring.

Each of the two optical writing units 1YM and 1CK includes a laser diode, a polygon mirror, various lenses, and the like. The optical writing units 1YM and 1CK drive the laser diode based on image information read out by a scanner disposed outside the printer and the image data sent from a personal computer. Each of the process units 2Y to 2K optically scans each surface of the photoconductors 3Y to 3K. Specifically, the photoconductor 3Y to 3K of the process units 2Y to 2K is driven in a counterclockwise direction in the figure by a drive means. The optical writing unit 1YM performs optical scanning by irradiating laser beams onto the rotating photoconductor 3Y, 3M while causing each beam to be polarized in the rotary axis direction. Due to this scanning exposure, an electrostatic latent image is formed on the photoconductors 3Y, 3M based on the Y-color image data and M-color image data, respectively. In addition, the optical writing unit 1CK irradiates laser beams onto the rotating photoconductor 3C, 3K while causing each beam to be polarized in the rotary axis direction, so that an optical scanning is performed. Due to this scanning exposure, an electrostatic latent image is formed on the photoconductors 3C, 3K based on the C-color image data and K-color image data, respectively.

Each of the process units 2Y to 2K is formed as a unit including a photoconductor as a latent image bearer and other parts and components disposed around the photoconductor, and each unit thus formed is held by a common support member and is detachably attachable to the housing of the printer. These process units are similarly configured to each other except that the color of toner each process unit handles is different. The process unit 2Y will be described as an example. The process unit 2Y includes, in addition to the photoconductor 3Y, a developing device 4Y to develop an electrostatic latent image formed on the surface of the photoconductor 3Y to render it a visible toner image. The process unit 2Y further includes a charger 5Y to uniformly charge a surface of the rotatably driven photoconductor 3Y, and a drum cleaner 6Y to clean residual toner deposited on the surface of the photoconductor 3Y after having passed through the primary transfer nip for Y-color, which will later be described.

The illustrated printer employs a so-called tandem structure, in which the four process units 2Y to 2K are sequentially disposed along an intermediate transfer belt 61, to be described later.

The photoconductor 3Y is drum-shaped and employs a base tube formed of aluminum on which a photosensitive layer with organic photosensitizing agent with photosensitivity is coated. Alternatively, an endless-belt shaped photoconductor may be used.

The developing device 4Y develops the latent image with two-component developer (hereinafter, simply referred to as a developer) including magnetic carrier particles and non-magnetic Y-color toner. Y-color toner inside the Y-toner bottle 103Y is supplied to the developing device 4Y via a Y-toner supply device, if needed. A toner density sensor 203 (see FIG. 2) is disposed inside the developing device 4Y. The toner density sensor 203 detects permeability resulted from carrier particles as magnetic members and calculates toner density from the amount of carrier particles included in a predetermined volume of toner. The toner density inside the developing device is detected by the toner density sensor 203, and is controlled within a predetermined range, for example, from 4 wt % to 8 wt %.

The drum cleaner 6Y employs a cleaning blade formed of polyurethane rubber that cleans the surface of the photoconductor 3Y by contacting it with pressure. However, any other type of cleaning blade may be used. In order to improve cleanability, the present printer employs a rotatable fur brush that contacts the photoconductor 3Y. The fur brush scrapes a lubricant off from a solid lubricant and, making the lubricant into fine particles, coats the lubricant on the surface of the photoconductor 3Y.

A discharge lamp is disposed above the photoconductor 3Y, which is included as a part of the process unit. The discharge lamp electrically discharges the surface of the photoconductor 3Y that has passed through the drum cleaner 6Y, by light exposure. The discharged surface of the photoconductor 3Y is uniformly charged by the charger 5Y and is optically scanned by the optical writing unit 1YM. The charger 5Y receives a charging bias from a power source and rotatably drives. Alternatively, a scorotron charger that charges the surface of photoconductor 3Y without contacting thereto, may be used.

Although the process unit 2Y for Y-color has been described, other process units 2M, 2C, and 2K are similarly configured as the process unit 2Y.

An intermediate transfer unit 60 is disposed below the four process units 2Y to 2K. The intermediate transfer unit 60 causes the intermediate transfer belt 61, stretched by a plurality of rollers 63, 67, and 71, to endlessly move in the clockwise direction while contacting the photoconductors 3Y to 3K via one of rollers that rotatably moves. With this structure, a primary transfer nip for Y-, M-, C-, and K-color is formed at each portion where the photoconductors 3Y to 3K contact the intermediate transfer belt 61, respectively.

Primary transfer rollers 62Y, 62M, 62C, and 62K are disposed on an interior loop of the intermediate transfer belt 61. The intermediate transfer belt 61 is pressed by the primary transfer rollers 62Y, 62M, 62C, and 62K near the primary transfer nip for Y-, M-, C-, and K-color, against the photoconductors 3Y to 3K. These primary transfer rollers 62Y to 62K each are applied with a primary transfer bias from the power source. With this structure, a primary transfer electric field to electrostatically move the toner image on the photoconductors 3Y to 3K toward the intermediate transfer belt 61 is formed at each primary transfer nip for Y-, M-, C-, and K-color.

Each toner image is primarily transferred by sequentially superimposing at each primary transfer nip on the outer surface of the intermediate transfer belt 61 endlessly moving in the clockwise direction while sequentially passing through the primary transfer nip for Y-, M-, C-, and K-color. With the superimposing primary transfer, a four-color toner image is formed on the outer surface of the intermediate transfer belt 61.

A secondary transfer roller 72 is disposed below the intermediate transfer belt 61 while contacting an outer surface of the belt where the secondary backup roller 68 is stretched around the intermediate transfer belt 61, thereby forming a secondary transfer nip. With this nipping, the secondary transfer nip is formed at a portion where the outer surface of the intermediate transfer belt 61 contacts the secondary transfer roller 72.

The secondary transfer roller 72 is applied with a secondary transfer bias from the power source. On the other hand, the secondary transfer backup roller 68 inside the belt loop is earthed. Accordingly, a secondary transfer electric field is formed in the secondary transfer nip.

The registration roller pair 34 is disposed on the right of the secondary transfer nip in the figure and sends out the recording sheet P nipped between rollers toward the secondary transfer nip at a timing in synchrony with the four-color toner image on the intermediate transfer belt 61. In the secondary transfer nip, the four-color superimposed toner image on the intermediate transfer belt 61 is secondarily transferred en bloc onto the recording sheet P due to effects of the secondary transfer electric field and nip pressure, so that a full-color toner image is formed on the recording sheet with added performance of white color of the recording sheet.

In addition, a transfer unit other than the intermediate transfer unit 60 is formed including the secondary transfer roller 72. The transfer unit further includes the secondary transfer belt 77 and a secondary transfer belt cleaner 76.

Figure 2:
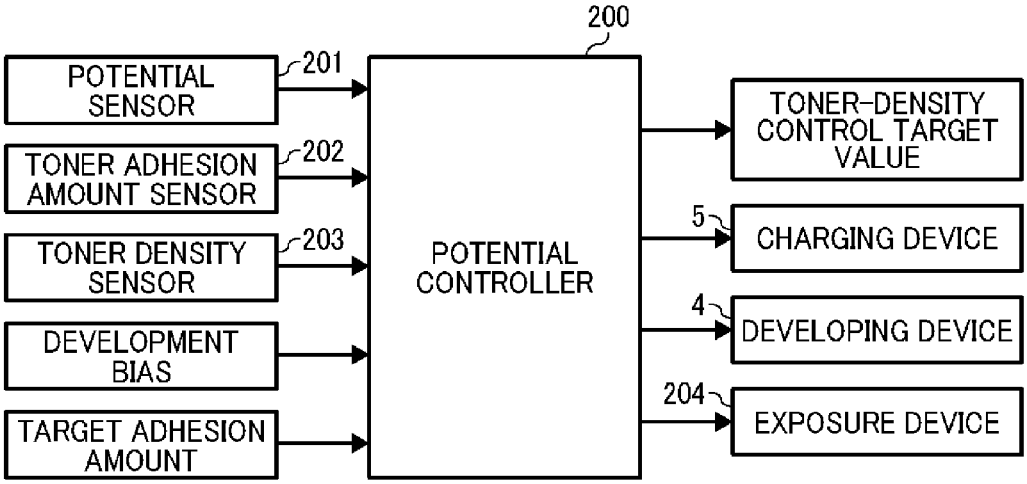
FIG. 2 is a block diagram illustrating a controller of an image density according to an embodiment of the present invention.

In the present image forming apparatus, when the recording sheet P passes through a nip between the secondary transfer roller 72 and the intermediate transfer belt 61, a visual image on the intermediate transfer belt 61 is transferred onto the recording sheet P. In addition, when performing a process control as illustrated in FIG. 2, the toner image can be transferred onto the secondary transfer belt 77, and the amount of adhered toner on the secondary transfer belt 77 can be detected by a reflection-type optical sensor such as a secondary transfer toner sensor 64.

The secondary transfer toner sensor 64 is a reflection-type optical sensor constructed of an LED as a light emitting element, a specular reflected light receiving element, a diffusion optical light receiving element, a glass cap, and a casing. In addition, as a light emitting element, a laser light emitting element may be used instead of the LED. In addition, as the specular reflected light receiving element or the diffusion light receiving element, a photo transistor is used for the both; however, the photo diode or the one including amplifier circuit may be used.

Infrared light emitted from the LED serving as a light emitting element passes through the glass cap and reaches a toner pattern formed on the secondary transfer belt 77. Part of the infrared light is specularly reflected by a surface of the toner pattern, again passes through the glass cap, and is received by the specular reflected light receiving element. The specular reflected light element outputs a voltage corresponding to a received light amount. The output value is converted by an A/D converter to digital data, and is input into a potential controller 200. Part of the infrared light is diffused and reflected by the surface of the toner pattern, and again passes through the glass cap as the diffused reflection light, and is received by the diffused light receiving element. The diffused light receiving element outputs a voltage corresponding to a received light amount. The output value is converted by the A/D converter to digital data, and is input to the potential controller 200.

The potential controller 200 receives an amount of light that varies with and is indicative of the amount of adhered toner per unit area for a toner patch of each gray scale pattern by the specular reflected light receiving element and the diffused light receiving element, and outputs a voltage corresponding to the received light amount.

Residual toner not transferred to the recording sheet P in the secondary transfer nip adheres to an outer surface of the intermediate transfer belt 61 that has passed through the secondary transfer nip. The residual toner is removed by a belt cleaner 75 that is configured to contact the intermediate transfer belt 61.

The recording sheet P that has passed through the secondary transfer nip is separated from the intermediate transfer belt 61, and is conveyed to a conveyance belt unit 35. The conveyance belt unit 35 includes a drive roller 37, a driven roller 38, and an endless conveyance belt 36 stretched between the drive roller 37 and the driven roller 38. The conveyance belt 36 is caused to endlessly move in the counterclockwise direction in the figure by a rotary drive of the drive roller 37. The recording sheet P that has passed through the secondary transfer nip is conveyed while being held on the stretched surface of the conveyance belt 36 along with the endless move of the belt 36, to a fixing device 40.

The recording sheet P that has passed through the secondary transfer nip is conveyed into the fixing device 40 and is nipped by the fixing nip. Then, the toner image is fixed onto the recording sheet P with heat and pressure applied.

After the toner image is transferred on a first side of the recording sheet P in the secondary transfer nip and the toner image on the first side is fixed by the fixing device 40, the recording sheet P is sent to a conveyance switchover device 50.

In the printer according to the present embodiment, the conveyance switchover device 50, a resending path 54, a switchback path 55, a conveyance path 56 after the switchback, and the like, all together construct a resending path. Specifically, the conveyance switchover device 50 switches a destination of the recording sheet P received from the fixing device 40 to either the sheet ejection path 51 or the resending path 54. During one-side printing mode in which the first side of the recording sheet P alone is printed, the conveyance switchover device 50 sets the destination of the recording sheet P to the sheet ejection path 51. As a result, the recording sheet P the first side of which is printed is conveyed to a sheet ejection roller pair 52 via the sheet ejection path 51 and is discharged onto a sheet ejection tray 53. During two-side printing mode in which both sides of the recording sheet P are printed, the conveyance switchover device 50 sets the destination of the recording sheet P to the sheet ejection path 51 when receiving the recording sheet P with fixed images on both sides. Accordingly, the recording sheet P on both sides of which images are formed is discharged onto the sheet ejection tray 53. In contrast, in the two-side printing mode, the conveyance switchover device 50 sets the destination of the recording sheet P to the resending path 54 when receiving the recording sheet P on the first side of which images are formed, from the fixing device 40.

The switchback path 55 links to the resending path 54, and the recording sheet P conveyed to the resending path 54 enters the switchback path 55. Then, when the recording sheet P wholly enters the switchback path 55, the conveyance direction of the recording sheet P is reversed and the recording sheet P is switched back. The switchback path 55 links to the conveyance path 56 after the switchback, other than the resending path 54, and the switched-back recording sheet P enters the conveyance path 56 after the switchback. At this time, the recording sheet P flips upside down. The upside-down recording sheet P passes through the conveyance path 56 after the switchback and the sheet feed path 30, and is again conveyed to the secondary transfer nip. The recording sheet P to the second side of which the toner image is transferred in the secondary transfer nip passes through the fixing device 40, so that the toner image is fixed on the second side. Thereafter, the recording sheet P passes through the conveyance switchover device 50, the sheet ejection path 51, and the sheet ejection roller pair 52, and is ejected onto the sheet ejection tray 53.

FIG. 2 is a block diagram illustrating controlling an image density according to an embodiment of the present invention.

Figure 4:
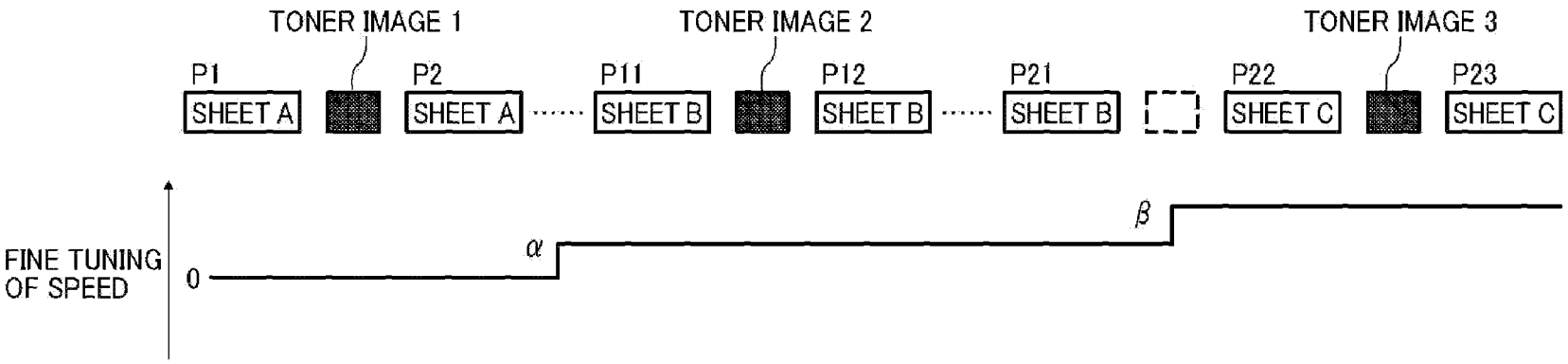
FIG. 4 is a timing chart illustrating the density control process executed by the image forming apparatus according to an embodiment of the present invention.

The image forming apparatus 100 according to the present embodiment includes a control circuit as depicted in FIG. 2. As illustrated in FIG. 2, a potential controller 200 is disposed as a part of image density control circuitry and is configured to appropriately control the apparatus using data as illustrated in FIG. 4. The image density control executed by the potential controller 200 includes:

[1] operation performed outside printing and regularly performed when the power is on, before a start of printing, after a predetermined number of prints has been performed, or after the printing is complete, referred to as a first operation [1 ]; and

[2] operation performed regularly in synchrony with the printing operation during printing and between two successive recording sheets (referred to as a second operation [2].

These operations are described below.

First Operation [1]

The potential controller 200 forms toner images with different amounts of adhered toner, detects a potential of the pattern of electrostatic latent image with a potential sensor 201, and an amount of adhered toner of the toner image on the secondary transfer member with a sensor. Further, the potential controller 200 detects the amount of adhered toner by a toner sensor 202, and calculates a charging bias, a developing bias, and an exposure for a target amount of adhered toner.

More specifically, the following values are input, including: a detection value detected by the toner sensor 202; a toner density detected by a toner density sensor 203; a surface potential after exposure of (any or all of) the photoconductors 3Y to 3K detected by the potential sensor 201; a developing bias; and a target amount of adhered toner. The potential controller 200 outputs the charging bias of the chargers 5Y, 5M, 5C, and 5K; the developing bias of the developing devices 4Y, 4M, 4C, and 4K; the exposure amount of the exposure device 204 which corresponds to the optical writing units 1YM and 1CK as illustrated in FIG. 1; and the toner-density control target value K. According to the optimal image forming conditions, each bias and toner supplies are controlled, so that a constant image density can be stably provided.

The image forming apparatus according to the present embodiment employs an image forming apparatus having an intermediate transfer belt of which a surface layer is formed of an elastic member to improve adhesion of the sheet. Because the elastic intermediate transfer belt includes a low surface glossiness in general, when the toner image formed on the intermediate transfer belt is detected with an optical sensor to control an adhesion amount of the toner image, the density or adhesion amount of the toner cannot be detected accurately. Thus, a plurality of toner images with a different amount of adhered toner is transferred on the secondary transfer belt 77, the amount of adhered toner is detected by the secondary transfer toner sensor 64, and the above control is performed. Calculation of the amount of adhered toner or determination of the image forming conditions may be performed with a conventional method.

Second Operation [2]

The potential controller 200 forms at least one toner image between successive recording sheets, optimizes image forming conditions during printing so as not to change the image density as adjusted in the first operation [1], and maintains the image density stably during adjustment performed in the first operation [1].

Figure 3:
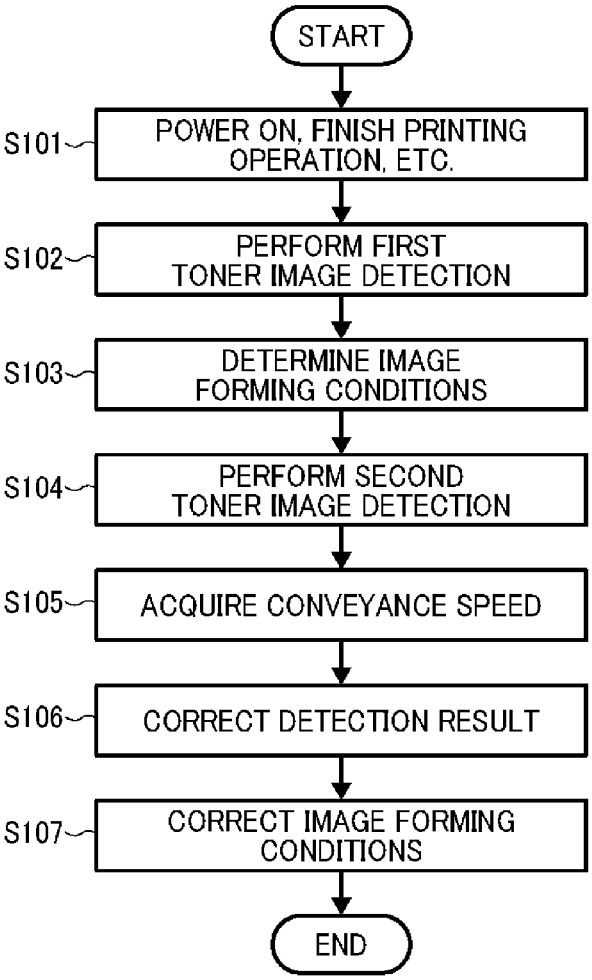
FIG. 3 is a flowchart illustrating an image density control process according to an embodiment of the present invention.

FIG. 3 is a flowchart illustrating a flow of control of image density according to an embodiment of the present invention.

Steps S101, S102, and S103

The image forming apparatus to which the present invention is applied regularly performs adjustments of the image forming conditions, for example, when the power is on, before the start of printing, after a predetermined number of prints has been made, or after the image forming operation is complete (in Step S101).

In the present embodiment, the secondary transfer toner sensor 64 disposed on the secondary transfer belt 77 (see FIG. 1) detects toner image for inspection, and the image forming conditions during printing is determined based on a relation between each of the detected amount of adhered toner and image forming conditions (such as a charging bias, developing bias, and exposure) to define the amount of adhered toner. Calculation of the amount of adhered toner or correction of the image forming conditions may be performed with a conventional method.

In addition, to maintain the image density at a constant level, the image forming conditions need to be regularly adjusted (as in Step S102). However, when the adjustment is performed during printing, because the printing operation is interrupted, productivity declines. Accordingly, by forming a toner image between successive recording sheets, that is, outside the image forming area of each sheet during printing, the image density fluctuation during printing is corrected. Herein, to correct image forming conditions during printing, the toner pattern for inspection of the image density is formed and detected simultaneously (S103).

Steps S104, S105, S106, and S107

At an interval of a predetermined number of sheets (for example, 10 sheets) during printing, the toner image for inspection of the target image density is formed in synchrony with the printing operation outside the image forming area (such as an end of the image or between successive sheets) as performed in step S104, output value reflected from the toner image is obtained. At the same time, a conveyance speed of the toner image by the transfer member is obtained (S105), and the calculated amount of adhered toner is corrected from a difference from the conveyance speed obtained in the first density control (S106, S107).

FIG. 4 is a timing chart of control of the image density in an image forming apparatus according to an embodiment of the present invention. FIG. 4 is a block diagram illustrating a timing to fine-tune the sheet conveyance speed and a secondary density control according to an embodiment of the present invention. In the present embodiment, the conveyance speed of the transfer sheet is fine-tuned in accordance with the type of the sheet to be conveyed. The timing to fine-tune is immediately before the sheet type for printing is changed. In addition, the second density control is performed at an interval of ten sheets.

Toner Image 1

When the conveyance speed in the second control is the same in the first density control (that is, fine-tuning the speed is zero), because there is no need to consider effects of fine-tuning of the secondary transfer speed, correction of the sensor detection value (Step S106) is not performed and the calculation of the amount of adhered toner and the image forming condition are corrected. Calculation of the amount of adhered toner or correction of the image forming conditions may be performed with a conventional method.

Toner Image 2

When the conveyance speed is fine-tuned by $+\alpha$ [%] from the first density control, the calculated amount of adhered toner is corrected (Step S106).

Toner Image 3

A case in which the conveyance speed is fine-tuned by $+\beta$ [%] from the first density control is illustrated. When the second density control and the fine-tuning of the conveyance speed are performed simultaneously, the second density control is performed between the current sheet and the next sheet. Specifically, when the conveyance speed is changed, the toner image detection in the blank area according to the second operation [2] is not performed. Alternatively, after the second operation [2 ] is performed by widening a spacing between the sheet P21 and the sheet P22, and fine-tuning of the conveyance speed is performed. Specifically, when the toner image detection according to the second operation [2] is performed between sheets, the conveyance speed in the above operation [2] is changed to the same speed when the toner image detection according to the first operation [1] is performed.

<Correction of the Calculated Amount of Adhered Toner>

The calculated amount of adhered toner is corrected in accordance with fine-tuning of the conveyance speed.

When the secondary transfer speed is fine-tuned by $+\alpha$ [%] to maintain the sheet conveyance speed to be constant, the toner image formed between sheets by the density control according to the second operation [2] is lengthened by $+\alpha$ [%] on the second transfer belt, and as a result, the amount of adhered toner is calculated to be less by a [%]. Then, in the control according to the embodiment, the calculated amount of adhered toner is corrected by the correction formula as shown below. Specifically, the detection result obtained by the toner sensors is corrected based on the speed adjustment data by the conveyance speed adjusting means, and the image forming conditions are corrected.

$$\text{Calculated amount of adhered toner [after correction]} = \text{amount of adhered toner [detected value]} \times \{100/(100-\alpha)\} \quad \text{Correction formula}$$

The present invention is not limited to only the aforementioned embodiments, and many variations are possible for the ordinary engineer in the field within the technological concept of the present invention.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an endless belt-shaped image bearer that is rotatably supported and entrained around rollers;

a transfer member positioned to contact an outer surface of the image bearer;

a transfer device to transfer a toner image conveyed while being carried on the outer surface of the image bearer onto a transfer medium conveyed between the image bearer and the transfer member, and to transfer medium conveyed between the image bearer and the transfer member, and to transfer a toner pattern for inspection of an image density on the outer surface of the image bearer onto the transfer member;

a toner image sensor to detect the image density of the toner pattern transferred onto the transfer member;

a conveyance speed controller to tune a conveyance speed of the transfer member in accordance with a type of the transfer medium, wherein detection result of the toner image sensor is corrected based on the conveyance speed of the transfer member, and image forming conditions are corrected based on the corrected detection result of the toner image sensor; and a potential controller to implement a first toner image density control in which density control is performed regularly, when the image forming apparatus is not forming and image;

the potential controller to implement a second toner image density control in which the density control is performed regularly in synchrony with image formation but between successive sheets.

2. The image forming apparatus as claimed in claim 1, wherein the image bearer has an elastic surface layer.

3. A method of controlling image density of an image formed by an image forming apparatus, the method comprising:

tuning a conveyance speed of a transfer member in accordance with a type of the transfer medium;

forming a toner pattern on the transfer member outside the transfer medium;

detecting a toner image density of the toner pattern on a transfer member with a toner image sensor, determining image forming conditions based on a detection result of the toner image sensor;

obtaining a conveyance speed of the transfer member;

correcting the detection result of the toner image sensor based on the obtained conveyance speed of the transfer member;

correcting the image forming conditions based on the corrected detection result;

performing a first toner image density control process in which density control is performed regularly, when the image forming apparatus is not forming an image; and performing a second toner image density control process in which the density control is performed regularly in synchrony with image formation but between successive sheets.

4. The method as claimed in claim 3, wherein correcting the detection result is based on the conveyance speed detected when the first toner image density control process has been performed.

5. The method as claimed in claim 4, further comprising:

obtaining a conveyance speed in performing the second toner image density control process; and obtaining a difference from the conveyance speed in the first toner image density control process.

6. The method as claimed in claim 5, wherein, when the conveyance speed is changed, the second image density control is not performed.

7. The method as claimed in claim 3, wherein when the second toner image density control process is performed between successive sheets, the conveyance speed in the second image density control process is changed to the same speed when the first toner image density control process is performed.

8. The image forming apparatus of claim 1, wherein correcting the detection result is based on the conveyance speed of the transfer member when the first toner image density control has been performed.

9. The image forming apparatus of claim 1, wherein:

the conveyance speed controller obtains a conveyance speed in performing the second toner image density control process; and the conveyance speed controller obtains a difference from the conveyance speed in the first toner image density control process.

10. The image forming apparatus of claim 9, wherein when the conveyance speed is changed, the second toner image density control is not performed.

11. The image forming apparatus of claim 10. wherein when the second toner image density control is performed between successive sheets, the conveyance speed controller changes the conveyance speed in the second image density control to the same speed when the first toner image density control is performed.

* * * * *